US006719239B2

(12) United States Patent
Suzuki et al.

(10) Patent No.: US 6,719,239 B2
(45) Date of Patent: Apr. 13, 2004

(54) AUTOMATIC WEB SPLICING SYSTEM

(75) Inventors: Hisao Suzuki, Tokyo (JP); Fumio Kubo, Tokyo (JP); Shozo Horikawa, Tokyo (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/414,299

(22) Filed: Apr. 16, 2003

(65) Prior Publication Data

US 2003/0173450 A1 Sep. 18, 2003

Related U.S. Application Data

(63) Continuation of application No. PCT/JP01/09042, filed on Oct. 15, 2001.

(30) Foreign Application Priority Data

Oct. 16, 2000 (JP) ..... 2000-315339

(51) Int. Cl.[7] ..... B65H 19/14; B65H 19/18; B65H 19/16

(52) U.S. Cl. ..... 242/552; 242/554.6; 242/555; 156/504

(58) Field of Search ..... 242/552, 554.6, 242/555, 555.1; 156/504

(56) References Cited

U.S. PATENT DOCUMENTS 3,252,671 A * 5/1966 Phillips et al. ..... 242/554.6
4,131,501 A * 12/1978 Bottcher et al. ..... 242/555
4,415,127 A * 11/1983 Seragnoli ..... 156/504
5,101,701 A * 4/1992 Boldrini et al.
5,297,751 A * 3/1994 Boldrini et al.
6,328,088 B1 * 12/2001 Draghetti ..... 242/552

FOREIGN PATENT DOCUMENTS

| | | | |
|---|---|---|---|
| EP | 0619256 A1 | * | 10/1994 |
| JP | 61-53294 B2 | | 11/1986 |
| JP | 6-115776 | * | 4/1994 |
| JP | 9-77316 | * | 3/1997 |
| JP | 9-136751 | * | 5/1997 |
| JP | 10-45290 | * | 2/1998 |
| JP | 10-72151 | * | 3/1998 |
| JP | 10-265107 | * | 10/1998 |
| WO | WO 02/32799 A1 | * | 10/2001 |

* cited by examiner

*Primary Examiner*—John M. Jillions
(74) *Attorney, Agent, or Firm*—Birch, Kolasch Stewart & Birch, LLP

(57) ABSTRACT

An automatic splicing system is provided that includes a motor (20*a*) for rotating an active roll (R1) while a web (P1) is drawn from the roll (R1) toward a cigarette rod-manufacturing machine, a motor (20*b*) for rotating a standby roll (R2) when a residual of the roll (R1) reaches a predetermined amount or less so that a web (P2) is fed from the roll (R2), a splicing section (70) splicing the webs (P1; P2) and changing over the feeding of web from the roll (R1) to the roll (R2) when feed speeds of the webs match each other, and suction casings (42) disposed on feed paths of the webs, respectively, the suction casings drawing the webs thereinto temporarily. The rotational speeds of the motors (20*a* and 20*b*) are controlled so as to maintain drawn amounts of the webs in the respective suction casings (42) within a predetermined range.

6 Claims, 8 Drawing Sheets

AUTOMATIC WEB SPLICING SYSTEM

This is a continuation of PCT/JP01/09042 filed on Oct. 15, 2001.

TECHNICAL FIELD

The present invention relates to an automatic web splicing system provided to a machine for manufacturing cigarette rods or filter rods, and more specifically, to an automatic splicing system suitable for a web which is thin and the tensile strength of which is relatively low like a web used for wrapping paper of the cigarette rods.

BACKGROUND ART

An automatic web splicing system is indispensable for enabling the continuous operation of a machine for manufacturing cigarette rods or filter rods. The automatic splicing system of this kind automatically changes over a web feed from an active roll to a standby roll when the residual amount of the active roll becomes low in the process of feeding the web from the active roll toward the manufacturing machine. For the purpose of the changeover, the automatic splicing system comprises a reservoir device.

More specifically, the reservoir device has a reservoir disposed downstream of a main feed roller feeding the web toward the manufacturing machine, the reservoir being capable of reserving the web. Prior to the foregoing changeover of the rolls, the reservoir device causes the web from the active roll to be fed at a higher speed than the running speed of the web in the manufacturing machine in cooperation with the main feed roller, and reserves the web by the length required therein. For this reason, when the web feed is changed over from the active roll to the standby roll, it is possible to splice the web of the active roll to that of the standby roll, that is, to change over from the active roll to the standby roll, with the active roll stopped from rotating while the web which has been reserved in the reservoir is being supplied to the manufacturing machine.

During the web feed from the active roll, the active roll is subjected to predetermined braking force. Since the active roll is rotated against the braking force as the main feed roller rotates, the web is stably fed from the active roll toward the manufacturing machine.

In order to improve the production capacity of the manufacturing machine, it is required to increase the speed of operation of the manufacturing machine itself, that is, the rotational speed of the main feed roller. To this end, it is necessary to increase not only the braking force to be applied to the active roll but also the speed of operation of the automatic splicing system, that is, the speed in reserving the web into the reservoir.

However, the web used for manufacturing cigarette rods is thin and also relatively low in the tensile strength thereof. On this account, an increase in the braking force applied to the active roll tends to cause rupture of the web during the web feed. Accordingly, there is a limit to increase the speed of the web feed, or the rotational speed of the main feed roller.

In the automatic splicing system, the higher the speed of the web feed (web-consuming speed in the manufacturing machine) is made, the more the web-reserving speed and the web reserve amount in the reservoir increase. Consequently, it is extremely difficult to orderly reserve the web in the reservoir by a significant amount, and then to smoothly supply the reserved web from the reservoir toward the manufacturing machine.

When the web is intertangled in the reservoir during the web storing operation into the reservoir, there occurs a tear in a side edge of the web, which makes the web rupture easily. After the changeover of the above-mentioned rolls is completed, and the web reserved in the reservoir is exhausted, the web is fed from the standby roll. At this time, the standby roll is in a halt state while being subjected to the braking force. Therefore, at the start of the web feed from the standby roll, the standby roll is abruptly rotated by the pulling force due to the delivery of the web. Thus, the web of the standby roll is given a considerable shock, which easily causes rupture of the web.

An object of the present invention is to provide an automatic web splicing system capable of feeding a web at a high speed without causing rupture of the web, and of making a stable changeover from the active roll to the standby roll.

DISCLOSURE OF THE INVENTION

An automatic splicing system according to the present invention comprises a web feed source including a pair of web rolls, an active path for guiding a web drawn out from one of the web rolls to a main feed path as active web, and a standby path for causing the web drawn out from the other web roll to stand by as standby web.

Moreover, the automatic splicing system comprises a main feed roller disposed in the main feed path and feeding the active web toward a consumption device, residual amount-detecting means for detecting a residual amount of the web of said one web roll, a sub-feed roller disposed in the standby path and feeding the standby web from the other web roll along the standby path when the residual amount of the web reaches a predetermined value or less, speed-detecting means for detecting feed speed of the standby web, and splicing means splicing the standby web to the active web in a splicing position when the feed speed of the standby web matches that of the active web, and simultaneously severing the active web in a position upstream from the splicing position while severing the standby web in a position downstream from the splicing position, thus changing over the web to be fed from the main feed roller from the active web to the standby web.

The web feed source includes a pair of spindles on which the respective web rolls are mounted, driving means capable of rotating the web rolls individually by means of the respective spindles thereof, a pair of buffer chambers located in the active path and the standby path, respectively, the buffer chambers being capable of sucking and drawing the webs fed along the respective paths so as to make the webs into a U-shape, a pair of draw-detecting means for detecting amounts of the webs drawn into the respective buffer chambers, controlling means for controlling a rotational speed of each of the web rolls by means of the driving means so that the detected draw-in amount of the corresponding web may be maintained within a predetermined range.

According to the above automatic splicing system, while the active web is fed from one of the web rolls toward the consumption device, the rotational speed of the web roll is controlled so as to keep the draw-in amount of the active web to be drawn into the buffer chamber within the predetermined range. Accordingly, the active web stably runs on the path between the web roll and the main feed roller without slacking or suffering an excessive tension.

Thereafter, when the residual amount of the web roll reaches the predetermined value or less, the other web roll is rotated by the driving means therefor, and simultaneously the sub-feed roller is also rotated as the feed of the active web is continued. Thus, the feed of the standby web from the other web roll is started. When the feed speed of the standby web matches that of the active web, the splicing means splices the standby web to the active web, and the web to be fed by the main feed roller is changed over from the active web to the standby web.

In the above-described web-changeover process, the rotational speed of the other web roll is controlled to maintain the draw-in amount of the standby web drawn into the buffer chamber within the predetermined range, as in the case of the active web. The standby web also neither slacks nor suffers the excessive tension, so that the splicing operation of the active web and the standby web can be stably performed.

When the active web and the standby web are spliced together as described above, both the webs are in a running state, and therefore, tension proof strength required of these webs is small. Accordingly, even if the feed speed of the active web is high, the automatic web splicing operation can be securely carried out.

In addition, since the automatic web splicing operation does not require a reservoir device, there is no possibility of a trouble attributable to use of the reservoir device.

Preferably, the web feed source may further include exchanging means for interchanging positions of the foregoing web rolls. Specifically, the exchanging means comprises a roll mount provided with the spindles at both ends thereof and rotatably supported in a center position between the spindles and a motor for rotating the roll mount around the center position thereof.

In this case, when the automatic web splicing operation is accomplished, the roll mount is rotated, and the web rolls are interchanged with respect to their positions. In other words, the web roll of the standby web is moved to the position where the web roll of the active web has been located, and then the standby web is fed toward the consumption device as an active web.

Moreover, the web feed source may further include shifting means for shifting the buffer chambers individually along with the respective web rolls when the web rolls are interchanged. In this case, even if the web roll of the standby web is moved, the stable feed of the standby web can be secured.

Specifically, each of the buffer chambers is capable of reciprocating motion in a direction taken along a moving direction of the corresponding web roll and in a direction orthogonal to the moving direction thereof, that is, frontward and backward thereof. In this case, since the buffer chambers are shifted without interfering with each other, the web rolls can be smoothly interchanged.

On the other hand, the web feed source may further include pushing means for pushing the webs toward the respective buffer chambers. In this case, after the used web roll is replaced with a new one, the pushing means helps a standby web drawn out from the new web roll to be automatically drawn into the corresponding buffer chamber.

Moreover, the automatic splicing system may include a reservoir device for the active web. The reservoir device is disposed in the main feed path, that is, the reservoir is located downstream from the main feed roller, and temporarily reserves the active web prior to the automatic web splicing operation.

Such a reservoir device allows the feed speed of the active and standby webs to decrease at the time of the automatic web splicing operation, thereby making it possible to perform the automatic web splicing operation more stably. Additionally, the utilization of the reservoir does not stop the feed of the active web, so that a reserve amount of the active web required in the reservoir of the reservoir device, is small.

Furthermore, the consumption device is a machine for manufacturing cigarette rods, filter rods or filter cigarettes. The automatic splicing system feeds the webs for cigarette rods, filter rods or filter cigarettes toward the machine, and carries out the automatic splice thereof.

BEST MODE OF CARRYING OUT THE INVENTION

Figure 1:
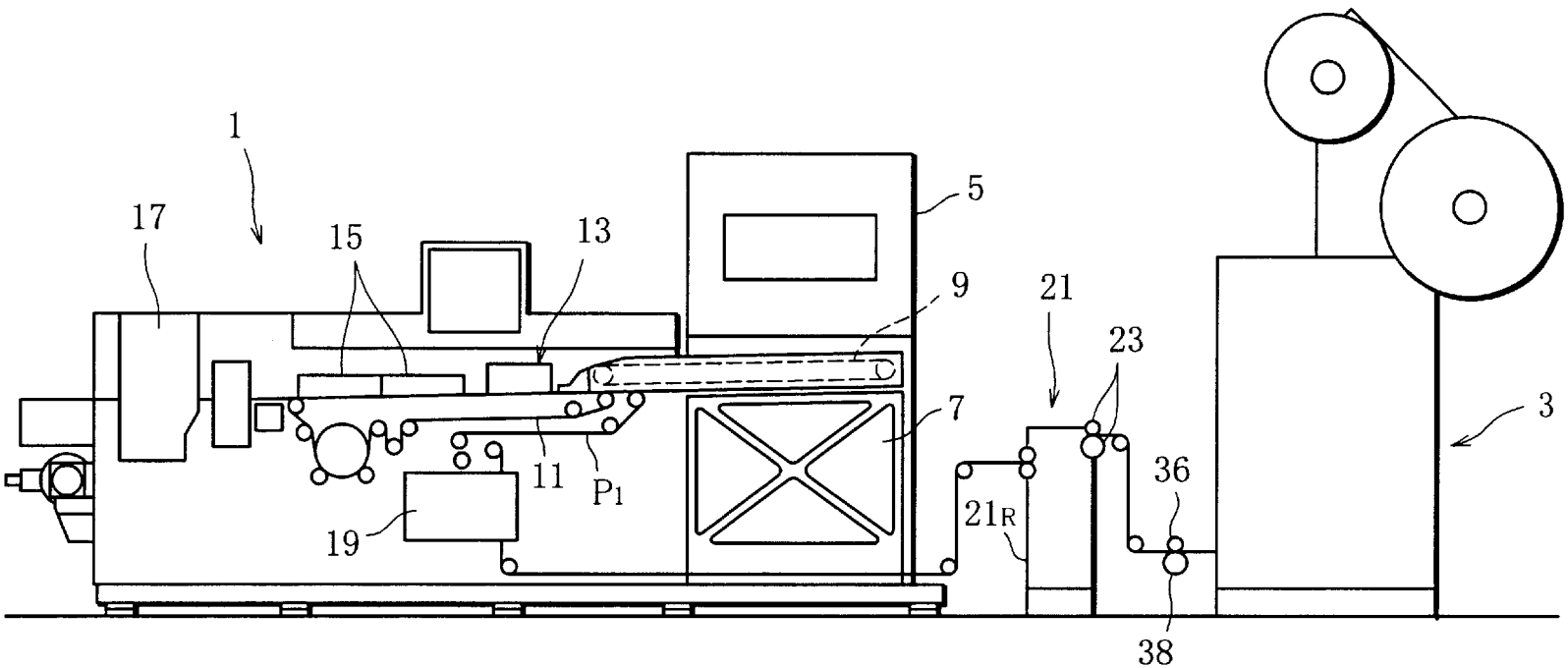
FIG. 1 is a schematic view of a cigarette rod manufacturing machine comprising an automatic web splicing system.

FIG. 1 illustrates a cigarette rod manufacturing machine 1 comprising an automatic web splicing system 3.

As is publicly known, the manufacturing machine 1 supplies shredded tobacco from a feeder 5 to an endless tobacco band 9 through a chimney 7. Accordingly, the shred tobacco is attracted by suction onto a lower surface of the tobacco band 9 in layers to form a shredded tobacco layer (not shown). The tobacco layer travels with the tobacco band 9 and then is supplied to a web P1 on an endless garniture tape 11. The web P1 is fed from the automatic web splicing system 3.

The shredded tobacco and the web P1 pass a wrapping section 13 of the manufacturing machine 1 together with the garniture tape 11. In this process, the shredded tobacco layer is wrapped in the web P1, and thus a tobacco rod (not shown) is continuously formed. Then, the tobacco rod passes a cutting section 17 via heaters 15 and is severed into discrete cigarette rods in the cutting section 17. The cigarette rod is twice as long as the cigarette of a filter cigarette.

Extended between the wrapping section 13 and the automatic splicing system 3 is a main feed path of the web P1. On the main feed path, there are located a printer 19 and a reservoir device 21 in order from the wrapping section 13 side. The printer 19 prints predetermined information onto the web P1. The reservoir device 21 comprises a reservoir 21R and is capable of storing the web P1 in the reservoir 21R.

More specifically, the reservoir device 21 further comprises a pair of pulling rollers 23 disposed at an inlet of the reservoir 21R. The pulling rollers 23 can draw the web P1 into the reservoir 21R at a speed higher than a running speed of the web P1 on the manufacturing machine 1 side, that is, at running speed of the garniture tape 11. Thus, the web P1 of a predetermined length is temporarily reserved in the reservoir 21R.

Figure 2:
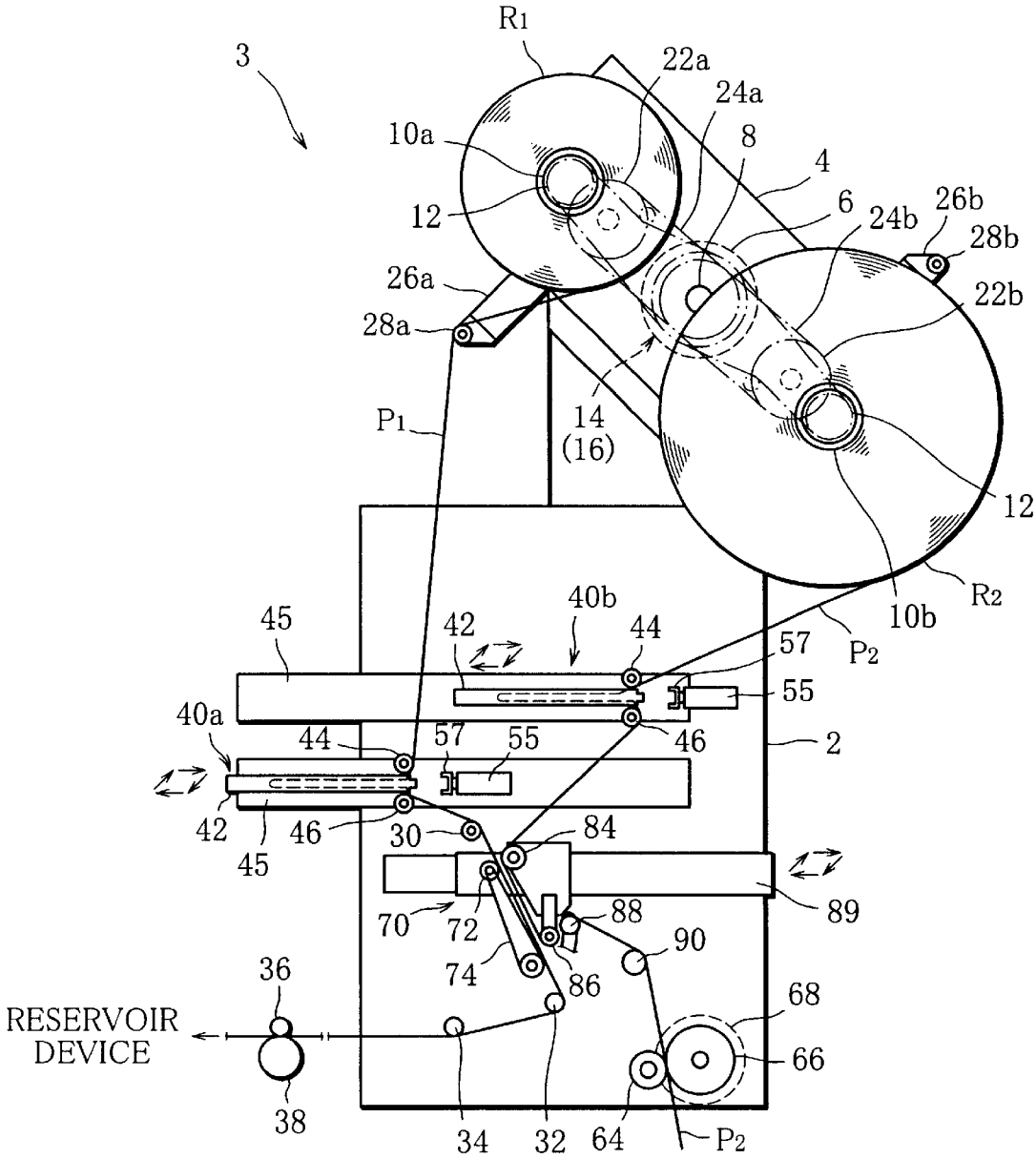
FIG. 2 is a schematic view of the automatic splicing system shown in FIG. 1.

As illustrated in FIG. 2, the automatic splicing system 3 comprises a main frame 2 having a plate-like roll mount 4 on top thereof. The roll mount 4 is mounted on an output shaft 8 of a reversing motor 6 at the center thereof. The reversing motor 6 is supported by the main frame 2. When the output shaft 8 of the reversing motor 6 is rotated, the roll mount 4 rotates around the output shaft 8.

Spindles 10*a* and 10*b* are disposed through both ends of the roll mount 4, respectively, and rotatably supported by the roll mount 4. Removably loaded on each spindle 10 is a web roll R. These web rolls R are arranged in a same vertical plane.

Figure 3:
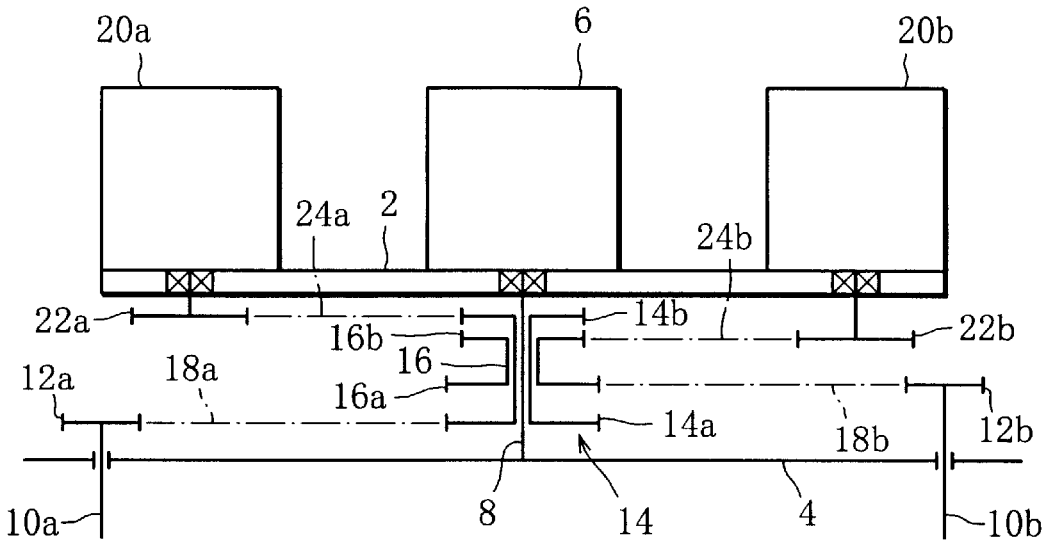
FIG. 3 is a view illustrating a power transmission path for rotating rolls shown in FIG. 2.

As shown in FIG. 3, gear pulleys 12*a* and 12*b* are mounted on the respective spindles 10, and double gear pulleys 14 and 16 of a double structure are mounted on the output shaft 8 of the reversing motor 6. More specifically, the double gear pulley 14 has a sleeve shaft rotatably supported on the output shaft 8 and first and second gear pulleys 14*a* and 14*b* located on both ends of the sleeve shaft, respectively. The double gear pulley 16 has a sleeve shaft rotatably supported on the sleeve shaft of the double gear pulley 14 and first and second gear pulleys 16*a* and 16*b* located on both ends of the sleeve shaft, respectively.

The gear pulley 12*a* and the first gear pulley 14*a* of the double gear pulley 14 are connected to each other with an endless gear belt 18*a* therebetween. The gear pulley 12*b* and the first gear pulley 16*a* of the double gear pulley 16 are connected to each other with an endless gear belt 18*b* therebetween.

On the main frame 2, drive motors 20*a* and 20*b* are supported on both sides of the reversing motor 6, respectively, and gear pulleys 22*a* and 22*b* are mounted on respective output shafts of the drive motors 20. The gear pulley 22*a* and the second gear pulley 14*b* of the double gear pulley 14 are connected to each other with an endless gear belt 24*a* therebetween. The gear pulley 22*b* and the second gear pulley 16*b* of the double gear pulley 16 are connected to each other with an endless gear belt 24*b* therebetween.

Therefore, the drive motors 20*a* and 20*b* are connected to the spindles 10*a* and 10*b* through said power transmission path, respectively, and capable of causing the respective spindles 10, or the respective rolls R, to rotate individually.

Furthermore, as shown in FIG. 2, brackets 26*a* and 26*b* protrude from both ends of the roll mount 4, and guide rollers 28*a* and 28*b* are rotatably mounted on distal ends of the brackets 26, respectively.

Referring to FIG. 2, the left one of the rolls R is an active roll R1, and the right one is a standby roll R2.

The web P1 of the active roll R1 is fed along a predetermined active path. More specifically, the active path of the web P1 is defined by a guide roller 30 along with the guide roller 28*a*. The guide roller 30 is rotatably supported one the main frame 2 and connected to the main feed path of the web P1. In the concrete, the main feed path includes an upstream portion defined by guide rollers 32 and 34. The guide rollers 32 and 34 are rotatably supported on the main frame 2. A downstream portion of the main feed path is defined by a plurality of guide rollers (not shown), that are rotatably disposed outside of the main frame 2, the downstream portion extending to the manufacturing machine 1.

In the downstream portion of the main feed path, there is disposed a main feed roller 38 in the vicinity of the main frame 2, the main feed roller 38 having a pinch roller 36. The main feed roller 38 is rotated by a main feed motor (not shown) to further feed the web P1 along the main feed path toward the manufacturing machine 1.

Figure 4:
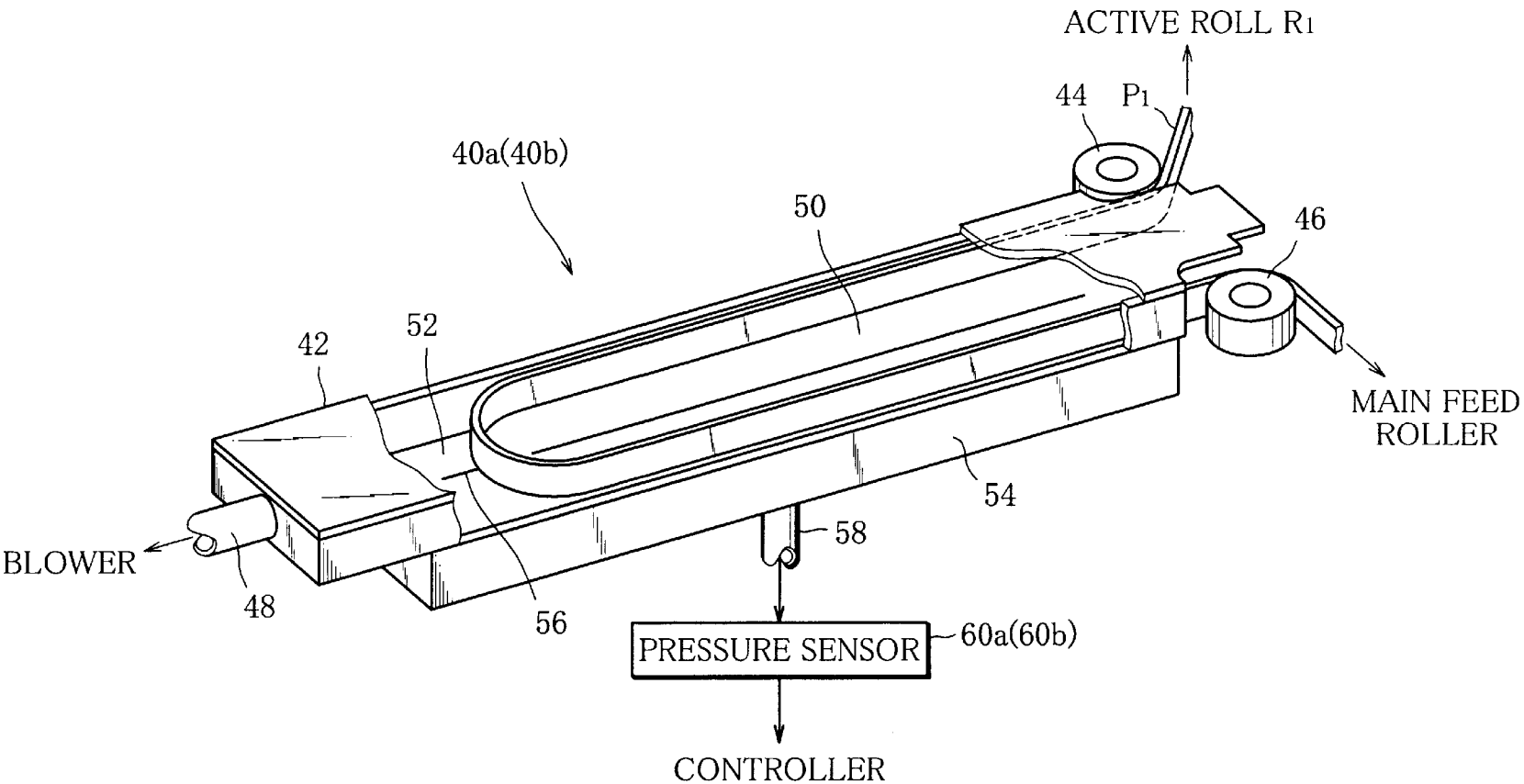
FIG. 4 is a partially cutaway perspective view illustrating a buffer device shown in FIG. 2.

There is disposed a buffer device 40*a* in the active path of the web P1. The detail of the buffer device 40*a* is illustrated in FIG. 4. In addition, FIG. 4 shows a state that the buffer device 40*a* is laid.

The buffer device 40*a* comprises a suction casing 42, which has a long rectangular shape. The suction casing 42 is horizontally disposed and has an opening only at one end thereof. In the vicinity of the opening end of the suction casing 42, there are rotatably disposed an inlet roller 44 and an outlet roller 46. The rollers 44 and 46 are arranged vertically away from each other so as to locate the opening end of the suction casing 42 therebetween.

The web P1 fed from the active roll R1 is once drawn into the suction casing 42 through the inlet roller 44, and then drawn out from the suction casing 42 through the outlet roller 46. More specifically, a suction passage 48 extends from the other end of the suction casing 42 and is connected to a blower. The blower discharges air in the suction casing 42 to generate a predetermined negative pressure therein. Such negative pressure draws the web P1 into the suction casing 42. The drawn-in web P1 is, as is obvious from FIG. 4, formed into a U-shape in the suction casing 42, thereby dividing an interior of the suction casing 42 into an open chamber 50 on the opening end side and a negative pressure chamber 52 on the suction passage 48 side. The negative pressure chamber 52 communicates with the suction passage 48.

Moreover, there is attached a long box 54 on a back surface of the suction casing 42. The box 54 extends in a longitudinal direction of the suction casing 42 and defines therein an internal chamber communicating with the interior of the suction casing 42 through a slit 56. As is clear from FIG. 4, the slit 56 extends from the open chamber 50 to the negative pressure chamber 52.

Figure 5:
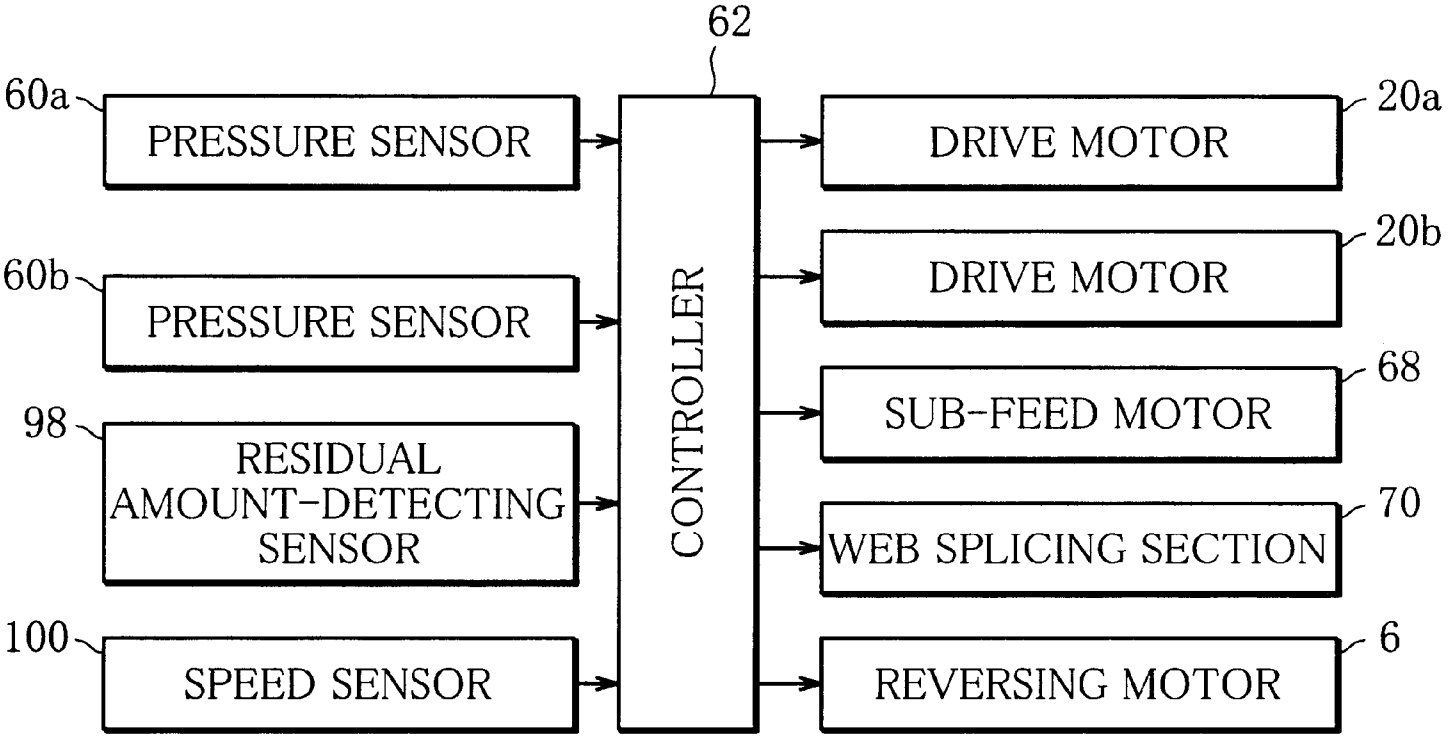
FIG. 5 is a block diagram for controlling operation of the automatic splicing system.

The box 54 is connected to a pressure sensor 60*a* with a passage 58 therebetween. The pressure sensor 60*a* detects pressure in the box 54 and outputs a detection signal to a controller 62 as shown in FIG. 5. The controller 62 is electrically connected to the drive motors 20*a* and 20*b* and controls rotational speed of the drive motor 20*a* of the active roll R1 side on the basis of the detection signal output from the pressure sensor 60*a*.

More specifically, when the main feed roller 38 is rotated at a predetermined speed, the drive motor 20*a* is also rotated at a predetermined rotational speed, and the web P1 is fed from the active roll R1. In other words, the web P1 is fed from-the active roll R1 in concurrence with the feed of the web P1 on the main feed path by the rotation of the main feed roller 38.

Therefore, when the feed speed of the web P1 determined by the drive motor 20*a* matches that by the main feed roller 38, a length of a U-shaped portion of the web P1 drawn into the suction casing 42 is constant. Accordingly, the slit 56 of the suction casing 42 is divided at a fixed rate by the U-shaped drawn-in portion of the web P1, thereby stabilizing pressure in the box 54.

However, if the feed speed of the web P1 determined by the drive motor 20*a* becomes lower than that by the main feed roller 38, the length of the U-shaped drawn-in portion of the web P1 is reduced, and the dividing rate of the slit 56 is changed. In this case, the length of a part of the slit 56 which is exposed in the negative pressure chamber 52 of the suction casing 42 is increased, and on the contrary, the length of a part of the slit 56 which is exposed in the open chamber 50 is decreased. In such a state, more air in the box 54 is discharged through the slit 56 and the negative pressure chamber 52, so that the pressure in the box 54 is lowered. The pressure sensor 60*a* detects the pressure reduction that occurs in the box 54 and sends the detected pressure reduction to the controller 62. In this case, the controller 62 accelerates the rotational speed of the drive motor 20*a* and increases the speed in feeding the web P1 from the active roll R1.

Thereafter, when the length of the U-shaped drawn-in portion of the web P1 is increased with the increase in the feed speed of the web P1 from the active roll R1, the part of the slit 54 which is exposed in the negative pressure chamber 52 is shortened, and on the contrary, that in the open chamber 50 is lengthened. On this account, more air under atmospheric pressure is supplied into the box 54 through the open chamber 50 and the slit 56, thus raising the pressure in the box 54. The pressure sensor 60*a* detects the pressure increase and sends the detected pressure increase to the controller 62. In this case, the controller 62 slows the rotational speed of the drive motor 20*a* and decreases the feed speed of the web P1 from the active roll R1.

In other words, the controller 62, on the basis of the pressure fluctuation in the box 54 detected by the pressure sensor 60*a*, controls the rotational speed of the drive motor 20*a*, and maintains a rate of the web P1 drawn into the suction casing 42, or the length of the U-shaped drawn-in portion of the web P1, within a predetermined range. As a result, when the web P1 is fed from the active roll R1, the web P1 hardly suffers the tensile force produced by the main feed roller 38, which enables a reduction in tension proof strength required of the web P1 itself. Consequently, even if the main feed roller 38 rotates at a high speed, it is possible to perform the stable feed of the web P1 from the active roll R1 without incurring rupture of the web P1, thereby greatly contributing to the high-speed operation of the manufacturing machine 1. Especially, the web used as wrapping paper for the cigarette rods is thinner than that used as wrapping paper for filter rods, and is low in tensile strength, so that the above-described feeding method of the web P1 is suitable for the cigarette rod manufacturing machine.

Figure 6:
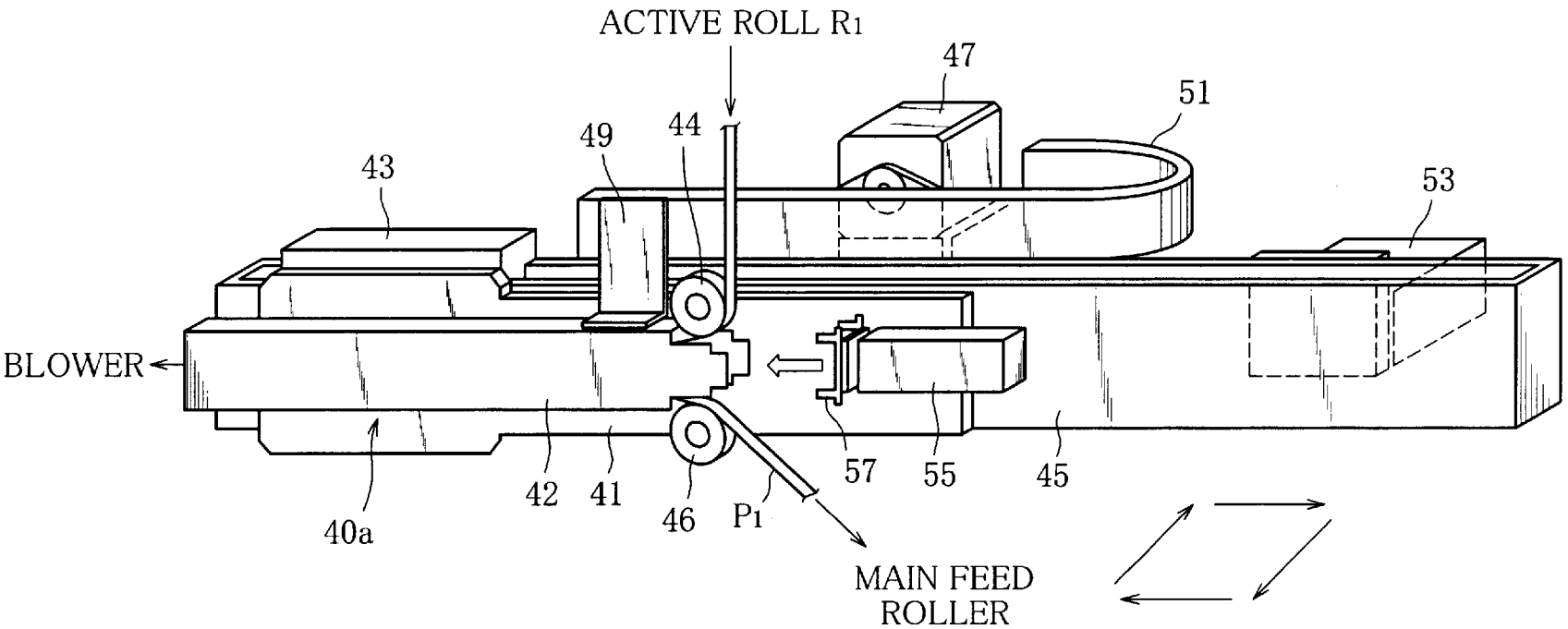
FIG. 6 is a schematic view illustrating a mechanism bringing the buffer device shown in FIG. 4 into reciprocating motion in frontward and backward as well as rightward and leftward in view of FIG. 6.

As illustrated in FIG. 6, for instance, the whole buffer device 40*a* is mounted on a plate-like holder 41. The holder 41 has a base end coupled with a slider 43. The slider 43 is arranged in a groove of a horizontal guide 45, which extends horizontally in a vertical plane including the active path of the web P1. For this reason, the slider 43 is capable of horizontal reciprocating motion along the main frame 2 in the groove of the horizontal guide 45.

There is supported a motor 47 on the horizontal guide 45 through a bracket, the motor 47 being connected to the slider 43 through a rack-and-pinion mechanism (not shown) of a double pinion-type. More specifically, the rack-and-pinion mechanism includes a rack fixed on the main frame 2 and extending in the horizontal direction, two pinions rotatably supported on the slider 43 and engaged with the rack, respectively, and a power transmission system connecting an output shaft of the motor 47 and the pinions.

Consequently, when the motor 47 is activated, the slider 43, or the suction casing 42, can move rightward and leftward in the horizontal direction, that is, from side to side in FIG. 2.

In addition, a central portion of the holder 41 and the suction casing 42 are coupled with a flexible band 51 through a bracket 49. The flexible band 51 smoothes the reciprocating motion of the suction casing 42.

There are disposed air cylinders 53 (FIG. 6 shows only one of the cylinders) between the both ends of the horizontal guide 45 and the main frame 2, respectively. The air cylinders 53 can move the horizontal guide 45, or the suction casing 42, in a direction orthogonal to the reciprocating motion thereof, that is, in a direction toward and away from the main frame 2. Therefore, the suction casing 42 can move frontward and backward in a horizontal plane.

Furthermore, there is mounted a pushing cylinder 55 on a distal end of the holder 41, the pushing cylinder 55 being opposed to the opening end of the suction casing 42. Mounted on a tip end of a piston rod of the pushing cylinder 55 is a pusher 57. The pusher 57 has a guide groove for directing the running of the web P1.

As shown in FIG. 2, a web P2 of the standby roll R2 is drawn out along a standby path and guided to a terminal of the standby path. Disposed at the terminal of the standby path is a sub-feed roller 66, which is provided with a pinch roller 64. The sub-feed roller 66 is mounted on the output shaft of a sub-feed motor 68, which is rotated by the controller 62.

As is obvious from FIG. 2, there is disposed a buffer device 40*b* in the middle of the standby path, the buffer device 40*b* being located about the buffer device 40*a*. The buffer device 40*b* has the same structure as the buffer device 40*a*. Accordingly, the suction casing 42 of the buffer device 40*b* is capable of the reciprocating motion in the horizontal direction along the horizontal guide 45, and also capable of the reciprocating motion with the horizontal guide 45 in the frontward and backward directions.

The web P2 guided from the standby roll R2 to the sub-feed roller 66 is once drawn into the suction casing 42 of the buffer device 40*b* so as to be formed into a U-shape, and then drawn out from the suction casing 42. As shown in FIG. 5, the pressure sensor 60*b* of the buffer device 40*b* is also electrically connected to the controller 62 to send the pressure fluctuation to the controller 62.

As illustrated in FIG. 2, there is located a web splicing section 70 between the active path of the active roll R1 and the standby path of the standby roll R2. A basic structure of the web splicing section 70 is disclosed in, for example, Examined Japanese Patent Publication No. Sho 61-53294. Therefore, the structure of the web splicing section 70 will be briefly explained below with reference to FIG. 7.

The web splicing section 70 comprises a splicing roller 72, which is located between the guide rollers 30 and 32. Accordingly, the web P1, after passing the guide roller 30, is guided to the guide roller 32 via the splicing roller 72. The splicing roller 72 is rotatably mounted on an upper end of a rocking lever 74, which is rotatably supported on the main frame 2 at the center thereof.

Connected to a lower end of the rocking lever 74 is a connecting cylinder 76 formed of an air cylinder, and the rocking lever 74 is rocked due to expansion and contraction of a piston rod 78 of the connecting cylinder 76. Additionally, the connecting cylinder 76 is also supported on the main frame 2.

There is fixed a cutting knife 82 at the upper end of the rocking lever 74 through a stay 80. The cutting knife 82 severs the web P1 when the rocking lever 74 in the state shown in FIG. 7 is rocked in a direction of arrow C, or clockwise.

There is rotatably disposed a receiving roller 84 in the vicinity of the splicing roller 72. The receiving roller 84 is located separately from the splicing roller 72, and the main feed path of the web P1 extends between the rollers 72 and 84. Rotatably disposed below the receiving roller 84 are reversing rollers 86 and 88, which are arranged separately from each other in a vertical direction. Moreover, a guide roller 90 is rotatably disposed below the reversing rollers 86 and 88.

The receiving roller 84 and the reversing roller 86 are mounted on a slide guide 89 (cf. FIG. 2). The slide guide 89 is also capable of the reciprocating motion rightward and leftward as well as frontward and backward in the same way as the buffer devices 40*a* and 40*b*.

Figure 7:
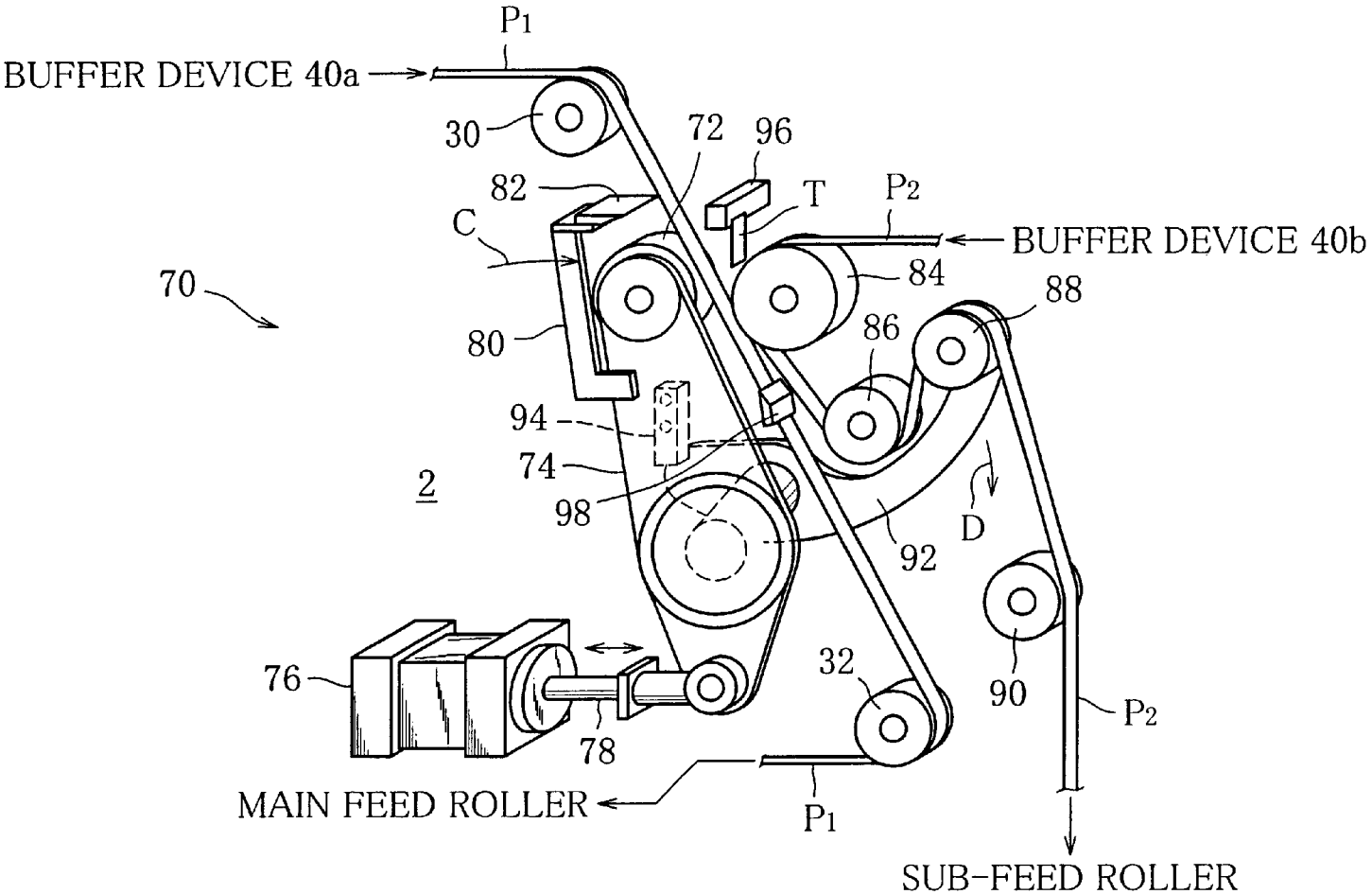
FIG. 7 is a schematic view illustrating a web splicing section of the automatic splicing system.

As is clear from FIG. 7, the web P2 drawn out from the standby roll R2 is guided between the sub-feed roller 66 and the pinch roller 64 through the receiving roller 84, the reversing rollers 86 and 88, and the guide roller 90.

On the other hand, the reversing roller 88 is rotatably supported at an end of a tension lever 92. The tension lever 92 is rotatably supported on a common shaft with the rocking lever 74. Moreover, the tension lever 92 is rotationally-biased downward, as indicated by arrow D in FIG. 7, by a spring (not shown) and the downward rotation of the tension lever 92 is however prevented by a stopper 94. In other words, the stopper 94 is disposed in the vicinity of the other end of the tension lever 92 and engaged with the other end of the tension lever 92 to maintain the reversing roller 88 in the position indicated in the figure. The stopper 94 is mounted on the rocking lever 74. When the rocking lever 74 in the state shown in FIG. 7 is rotated clockwise, the engagement between the other end of the tension lever 92 and the stopper 94 is released, and thus the tension lever 92 is rotated downward.

In a region between the receiving roller 84 and the reversing roller 86, the web P2 is close to the web P1 with a predetermined gap therebetween.

There is disposed a tape-supplying device 96 above the region, the tape-supplying device 96 being capable of sequentially feeding double-faces adhesive tapes of a predetermined length. More specifically, the tape-supplying device 96, for instance, partially peels off a double-faced adhesive tape from the continuously mount sheet therefor and locates a tip end of the peeled tape between the splicing roller 72 and the receiving roller 84. Furthermore, a cutting knife 98 is located fixedly below the receiving roller 84 and positioned between the webs P1 and P2.

In case that the web P1 is drawn out from the active roll R1 as described above, the rotation of the drive motor 20*b* and the sub-feed roller 66 which are on the standby roll R2 side is stopped. That is, the web P2 is in a stationary state.

However, if a residual amount of the web P1 of the active roll R1 reaches a predetermined value or less, the web splicing section 70 splices the web P2 to the web P1 and then feeds the web P2 of the standby roll R2 toward the manufacturing machine 1. Thus, the feed of the web is changed over from the active roll R1 to the standby roll R2.

In order to control the operation of the web splicing section 70, as illustrated in FIG. 4, the controller 62 is not only electrically connected to the section 70 but also electrically connected to a residual amount-detecting sensor 98 for detecting the residual amount of the web P1 of the active roll R1, a speed sensor 100 for detecting the feed speed of the web P2, and the reversing motor 6.

Moreover, the residual amount-detecting sensor 98 may be a sensor of either a contact or a noncontact type, and is disposed in the vicinity of the active roll R1. The speed sensor 100 is located on the standby path between the buffer device 40*b* and the sub-feed roller 66.

When the residual amount of the web P1 of the active roll R1 is reduced to the predetermined value or less, the reduction is detected by the residual amount-detecting sensor 98, which sends a roll switch signal to the controller 62.

In response to receipt of the switch signal, the controller 62 supplies a drive signal to the drive motor 20*b* and the sub-feed motor 68 and brings the sub-feed motor 68 to rotate up to a predetermined rotational speed. Therefore, the sub-feed roller 66 discharges the web P2 through an air-conveying tube (not shown) toward a recovery container while the web P2 is fed from the standby roll R2.

At the time of the feed of the web P2, the controller 62 controls the rotation of the drive motor 20*b* on the basis of the detection signal from the pressure sensor 60*b* on the buffer device 40*b* side, and maintains the length of the U-shaped drawn-in portion of the web P2 drawn into the suction casing 42 of the buffer device 40*b* within a predetermined range. Accordingly, the web P2 is smoothly fed from the standby roll R2 as well as the web P1, and at the time of the feed, there is not much necessity for tension proof strength of the web P2.

Figure 8:
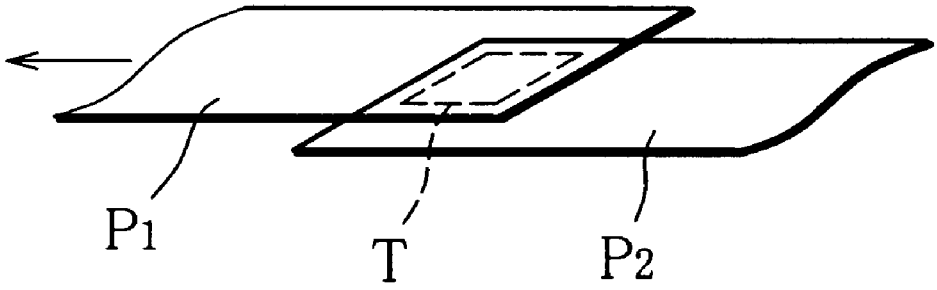
FIG. 8 is a perspective view illustrating a spliced state of webs.

Thereafter, the feed speed of the web P2 on the standby path is increased. When this feed speed matches the feed speed of the web P1 which is determined by the rotational speed of the main feed roller 38, the speed sensor 100 sends to the controller 62 a signal indicative that the feed speed of the web P2 matches that of the web P1. At this moment, the controller 62 contracts the splicing cylinder 76 of the web splicing section 70 and causes the rocking lever 74 to rotate clockwise. Therefore, the splicing roller 72 moves toward the receiving roller 84, and the rollers 72 and 84 tightly pinch the webs P1 and P2 so that the double-faced adhesive tape T is sandwiched between the webs P1 and P2. As a consequence, the webs P1 and P2 are connected to each other with the double-faced adhesive tape T therebetween as shown in FIG. 8. Then, a new double-faced adhesive tape T is drawn out from the tape-supplying device 96.

Along with the rotation of the rocking lever 74, the cutting knife 82 moves toward the web P1 to cut the web P1 at a position upstream from the splicing position of the webs P1 and P2.

Furthermore, the rotation of the rocking lever 74 releases the engagement of the rocking lever 74 and the stopper 94, and the clockwise rotation of the tension lever 92 brings the reversing roller 88 to descend. Such descent of the reversing roller 88 produces slack in the web P2 between the receiving roller 84 and the reversing roller 88. The slack portion is pulled by both downstream-side portions of the webs P1 and P2 on both sides of the cutting knife 98, respectively, when the splicing position of the webs P1 and P2 passes the cutting knife 98. For this reason, the cutting knife 98 cuts the web P2 in a position downstream from the splicing position of the webs P1 and P2. Consequently, the web P2 fed from the standby roll R2 is supplied to the main feed path on the main feed roller 38 side, so that the feed of the web P is changed over from the active roll R1 to the standby roll R2.

Subsequently, the rocking lever 74 is reversely rotated to be in the original position, and the splicing roller 72 is separated from the receiving roller 84. On the other hand, the tension lever 92 is also rotated upward to be in the original position, and then engaged with the stopper 94.

As is obvious from the above explanation, since the changeover of the rolls is carried out while the feed of the web P1 is continued, it is not necessary to use the reservoir device 21 for the changeover of the rolls.

Consequently, there never arises a problem such as a tear attributable to a tangle of the web in the reservoir device 21. Moreover, the web P2 is not abruptly fed from the standby roll R2 in the stationary state after the completion of the web splicing. Thus, the rupture of the web P2 is surely prevented.

After the changeover of the rolls is completed, the controller 62 stops the rotation of the drive motor 20*a* and that of the sub-feed roller 66. Moreover, the drive motor 20*a* is reversely rotated, and the web P1 which has been drawn out from the roll R1 is wound on the roll R1.

After the changeover of the rolls, the controller 62 similarly controls the rotational speed of the drive motor 20*b*, that is, the roll R2 which is in the active state at this time, on the basis of the detection signal transmitted from the pressure sensor 60*b*.

Then, the buffer device 40*a* is retreated from the active path where the web P1 has been fed, and the controller 62 causes the roll mount 4 to reversely rotate 180° clockwise in FIG. 2 through the reversing motor 6. The roll R2 and the roll R1 are thus interchanged.

At this time, the buffer device 40*b* moves along with the roll R2 in the moving direction of the roll R2, and then is stopped at a position above the buffer device 40*a*. Such displacement of the buffer device 40*b* allows the standby path, or the active path, of the web P2 to move while the feed of the web P2 is stably maintained. Thus, the web P2 drawn out from the buffer device 40*b* is guided to the main feed roller 38 side through the guide roller 30 and the splicing roller 72 as well as the web P1 before the changeover of the rolls. At this moment, since the buffer device 40*a* is located at the backward position, the web P2 does not interfere with the buffer device 40*a*.

More specifically, in conjunction with the displacement of the buffer device 40*b*, the buffer device 40*a* also moves along with the roll R1 in the moving direction of the roll R1, and is stopped above the position where the buffer device 40*b* has been located earlier.

Thereafter, the used roll R1 is removed from the spindle 10*a*, and a new web roll is mounted onto the spindle 10*a* as standby roll. The web of the new standby roll is drawn out so that the web passes between the suction casing 42 and the pusher 57 of the buffer device 40*a*. Thereafter, the web is guided to the sub-feed roller 66 through the receiving roller 84, the reversing rollers 86 and 88, and the guide roller 90. At this time, the receiving roller 84 and the reversing roller 86 are located at the backward positions as well as the buffer device 40*a*, so that the arrangement of the web from the new standby roll can be easily performed without interfering with the running web P2.

Then, the buffer device 40*a*, the receiving roller 84 and the reversing roller 86 are shifted frontward to the respective original positions, and the new web between the receiving roller 84 and the reversing roller 86, which is guided from the standby roll, closely faces the running web P2.

When the pushing cylinder 55 of the buffer device 40*a* is elongated, the pusher 57 catches the new web in the guide groove thereof and pushes out the new web toward the suction casing 42 of the buffer device 40*a*. Thus, the suction casing 42 automatically sucks the new web thereinto through the opening end thereof, and the new web falls into a standby state that is similar to the state shown in FIG. 2.

The present invention is not limited to the above-described embodiment, and may be modified in various ways.

For instance, if a rotational speed signal is transmitted from the sub-feed motor 68 to the controller 62, the controller 62 can detect the feed speed of the web P2 on the basis of the rotational speed signal from the sub-feed motor 68, which eliminates the necessity of the speed sensor 100.

Moreover, the web splicing section 70 is only an example, and is not limited to the construction illustrated in FIG. 7.

Furthermore, although the reservoir device 21 is not used at the time of changing over the rolls in the above embodiment, the reservoir device 21 may be utilized under the condition where the running speed of the web on the manufacturing machine side is very high.

More specifically, in cases where the running speed of the web on the manufacturing machine side is very high, there is fear that the splicing of the web P1 and the web P2 in the web splicing section 3 is unstably made. In this case, prior to the changeover of the rolls, the rotational speed of the pulling rollers 23 of the reservoir device 21 and that of the main feed roller 38 are increased to be higher than the rotational speed thereof in a steady operation, and the web P1 of a predetermined length is reserved in the reservoir 21R of the reservoir device 21. Then, the rotational speed of the pulling rollers 23 and that of the main feed roller 38 are reduced to be lower than the rotational speed thereof in the steady operation. When the changeover of the rolls, that is, the splicing performance between the web P1 and the web P2, is carried out in the above state, the splicing of the webs is stably made. Even in this case, since the feed of the web P1 from the active roll R1 is continued, it is not necessary to reserve a large quantity of the web P1 in the reservoir device 21. Thus, it is possible to avert trouble with the web P1 in the reservoir 21R.

Furthermore, the automatic splicing system according to the present invention is applied to the cigarette rod manufacturing machine, but may be applied to a machine for manufacturing filter rods as well.

What is claimed is:

1. An automatic web splicing system comprising:

a web feed source including a pair of web rolls, an active path guiding a web drawn out from one of the web rolls to a main feed path as an active web, and a standby path where a web drawn out from the other web roll is caused to stand by as a standby web;

a main feed roller disposed on the main feed path and feeding the active web toward a consumption device;

residual amount-detecting means for detecting a web residual amount of said one web roll;

a sub-feed roller disposed on the standby path, said sub-feed roller feeding the standby web from said other web roll along the standby path when the web residual amount reaches a predetermined value or less;

speed-detecting means for detecting a feed speed of the standby web; and splicing means for splicing the standby web to the active web in a splicing position when the feed speed of the standby web matches that of the active web, simultaneously cutting the active web in a potion upstream from the splicing position while cutting the standby web in a position downstream from the splicing position, and changing over the web to be fed from the main feed roller from the active web to the standby webs; wherein said web feed source includes:

a pair of spindles on which said web rolls are mounted, respectively;

driving means for rotating said web rolls individually through said respective spindles thereof;

a pair of buffer chambers located on the active path and the standby path, respectively, said buffer chambers being capable of sucking the webs fed along the respective paths and drawing the respective webs thereinto so as to form the respective webs into a U-shape;

a pair of draw-detecting means for detecting amounts of the webs drawn into said buffer chambers, respectively;

controlling means for controlling a rotational speed of each of said web rolls by means of said driving means so that the detected draw-in amount of the corresponding web is maintained within a predetermined range; and pushing means for pushing the webs toward the respective buffer chambers.

2. The system according to claim 1, wherein said web feed source further includes exchanging means for interchanging positions of said web rolls.

3. The system according to claim 2, wherein said exchanging means includes:

a roll mount provided with said spindles at both ends thereof, respectively, the roll mount being rotatably supported in a center position between said spindles; and a motor for rotating the roll mount around the center position thereof.

4. The system according to claim 2, wherein said web feed source further includes shifting means for shifting said buffer chambers individually along with the respective web rolls when said web rolls are interchanged.

5. The system according to claim 1, further comprising a reservoir device disposed in said main feed path, the reservoir device being located downstream from said main feed roller; wherein the reservoir device reserves the active web prior to a changeover from the active web to the standby web.

6. The system according to claim 1, wherein said web is used in manufacture of smoking articles including at least one of cigarette rods, filter rods and filter cigarettes.

* * * * *